US007653335B2

(12) United States Patent
Hirayama et al.

(10) Patent No.: US 7,653,335 B2
(45) **Date of Patent: *Jan. 26, 2010**

(54) DEVELOPING APPARATUS AND IMAGE FORMING APPARATUS

(75) Inventors: Junya Hirayama, Takarazuka (JP); Toshiya Natsuhara, Takarazuka (JP); Masahiko Matsuura, Suita (JP); Takeshi Maeyama, Kawanishi (JP); Shigeo Uetake, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 218 days.

This patent is subject to a terminal disclaimer.

(21) Appl. No.: 11/810,451

(22) Filed: Jun. 6, 2007

(65) Prior Publication Data

US 2007/0292165 A1 Dec. 20, 2007

(30) Foreign Application Priority Data

Jun. 15, 2006 (JP) ..... 2006-165699

(51) Int. Cl.
*G03G 15/09* (2006.01)
*G03G 15/01* (2006.01)
*G03G 15/08* (2006.01)

(52) U.S. Cl. ..... 399/272; 399/229; 399/232; 399/259; 399/281

(58) Field of Classification Search ..... 399/272, 399/232, 229, 259, 281
See application file for complete search history.

(56) References Cited

U.S. PATENT DOCUMENTS

| | | | | |
|---|---|---|---|---|
| 5,991,587 | A | 11/1999 | Kikuchi | 399/282 |
| 6,134,412 | A * | 10/2000 | Thompson | 399/266 |
| 6,348,292 | B1 * | 2/2002 | Pan et al. | 430/115 |
| 6,512,909 | B2 | 1/2003 | Ozawa et al. | 399/270 |
| 6,721,516 | B2 | 4/2004 | Aoki et al. | 399/55 |
| 7,435,520 | B2 * | 10/2008 | Bae | 430/108.6 |
| 2003/0027074 | A1 * | 2/2003 | Emoto et al. | 430/124 |

FOREIGN PATENT DOCUMENTS

| | | | |
|---|---|---|---|
| JP | 59-100471 | A | 6/1984 |
| JP | 9-185247 | A | 7/1997 |
| JP | 2000-298396 | A | 10/2000 |
| JP | 2002-108104 | A | 4/2002 |
| JP | 2003-57882 | A | 2/2003 |
| JP | 2003-215855 | A | 7/2003 |
| JP | 2005-189708 | A | 7/2005 |

* cited by examiner

*Primary Examiner*—David M Gray
*Assistant Examiner*—Rodney Bonnette
(74) *Attorney, Agent, or Firm*—Sidley Austin LLP

(57) ABSTRACT

A compact development apparatus using a two-component developer and an image forming apparatus wherein carrier deterioration is prevented to ensure formation of a high-quality image for a long time. The development apparatus uses the developer made up of a mixture of toner, carrier, and opposite polarity particles to be charged oppositely to the toner wherein the opposite polarity particles contain the particles having a relative dielectric constant of 6.7 or more.

20 Claims, 3 Drawing Sheets

DEVELOPING APPARATUS AND IMAGE FORMING APPARATUS

This application is based on Japanese Patent Application No. 2006-165699 filed on Jun. 15, 2006, in Japanese Patent Office, the entire content of which is hereby incorporated by reference.

TECHNICAL FIELD

The present invention relates to a development apparatus and image forming apparatus for developing a latent image on an image carrier using a developer containing toner and carrier.

BACKGROUND

In an image forming apparatus using an electrophotographic technology, two systems have been known in the conventional art to develop an electrostatic latent image formed on an image carrier. One is a one-component developing system that uses only toner as a developer, and the other is a two-component developing system that uses both toner and carrier.

In the one-component development system, a toner-supporting member and a regulating plate pressed against the toner-supporting member are generally used. The film thickness is regulated while the toner on the toner-supporting member is pressed by the regulating plate, whereby thin toner layer of a predetermined electrostatic charge can be formed. An electrostatic latent image is developed on the image carrier with this thin toner layer. This method is characterized by excellent dot reproducibility and is capable of providing uniform images with the minimum irregularity. This method also simplifies the structure, downsizes the apparatus and reduces the production cost. However, a heavy stress is applied to the toner in the regulating section made up of a toner-supporting member and a regulating plate pressed against the toner-supporting member. This will degenerate the toner surface, and the toner and external additive agent will attach to the toner regulating member and toner-supporting member surface, with the result that the electrostatic charge of toner is reduced. Thus, contamination inside the apparatus will be caused by fogging on the image and toner splashing due to poorly charged toner. This will lead to the problem of reducing the service life of the development apparatus.

In the meantime, in the two-component developing system, toner is charged by triboelectric charging through mixture between toner and carrier. This results in a smaller stress and greater resistance to possible deterioration of toner. Further, a carrier for electrostatically charging the toner has a greater surface area, and therefore, is more impervious to contamination due to toner or external additive agent. Thus, a longer service life can be expected.

However, the carrier surface is also contaminated by the toner and external additive agent even when the two-component developer is used. The electrostatic charge of toner is reduced through a long-term use, and problems of fogging and toner splashing will arise. The service life cannot be said to be sufficiently long. A still longer service life should be ensured.

A technique of ensuring a prolonged service life of the two-component developer is disclosed in the Unexamined. Japanese Patent Application Publication No. S59-100471. It discloses a development apparatus wherein the carrier, together with toner or independently, is supplied little by little, and the deteriorated developer of reduced charging property is removed accordingly, whereby the carrier is replaced by a new one and hence the percentage of the deteriorated carrier is reduced. Since the carrier is replaced in this apparatus, reduction of the electrostatic charge of toner caused by carrier deterioration is kept to a predetermined level. This technique is efficient in ensuring prolonged service life.

The Unexamined Japanese Patent Application Publication No. 2003-215855 discloses a two-component developer made up of the toner and carrier with the opposite polarity particles having the polarity opposite to that of the toner externally added thereto, and a method of development using this developer. The opposite polarity particles of this development method serve as an abrasive powder and spacer particles. The carrier deterioration can be minimized by removing the spent matters of the carrier surface.

The Unexamined Japanese Patent Application Publication No. H9-185247 discloses a so-called hybrid development method wherein a latent image on the image carrier is developed using the toner-supporting member for carrying only the toner from the two-component developer. The hybrid development method has many characters that cannot be found in the conventional two-component developing system. For example, there is no brush mark on the image by a magnetic brush, excellent dot reproducibility and image uniformity is provided, and migration of the carrier to the image carrier (carrier consumption) does not occur due to the lack of direct contact between the image carrier and magnetic brush. In the hybrid development method, the toner is provided with triboelectric charging with the carrier, and therefore, maintenance of the charge-applying property of the carrier (toner charged triboelectrically by toner and carrier) is important to stabilize the toner charging property and ensure a long-term image quality.

However, the Unexamined Japanese Patent Application Publication No. S59-100471 involves cost and environment problems because a mechanism for collecting the ejected carrier is necessary, and the carrier is a consumable product. Further, a predetermined number of printing operations must be repeated until the percentages of the old and new carrier is stabilized, and the initial characteristics cannot always be maintained. Further, in the Unexamined Japanese Patent Application Publication No. 2003-215855 and Unexamined Japanese Patent Application Publication No. H9-185247, the carrier surface is contaminated by toner and finishing agent with the increasing number of printed sheets, and the charge-applying property of the carrier is reduced.

SUMMARY

The object of the present invention is to provide a development apparatus and an image forming apparatus capable of forming high-quality images for a long time using a two-component developer. In view of forgoing, one embodiment according to one aspect of the present invention is a development apparatus for developing an electrostatic latent image in a development area, the apparatus comprising:

a developer tank which is adapted to store developer including toner, carrier for charging the toner, and opposite polarity particles which are charged in an opposite polarity to a polarity of electrostatic charge of the toner; and a conveyance mechanism which is adapted to convey the toner to the development area and to collect the opposite polarity particles back into the developer tank, wherein the relative dielectric constant of the opposite polarity particles is no less than 6.7 at 25° C.

According to another aspect of the present invention, another embodiment is an image forming apparatus, comprising:

an image carrier;

an image forming mechanism which is adapted to form an electrostatic latent image on the image carrier; and a development apparatus which is adapted to develop in a development area the electrostatic latent image formed on the image carrier, the development apparatus including:

a developer tank which is adapted to store developer including toner, carrier for charging the toner, and opposite polarity particles which are charged in an opposite polarity to a polarity of electrostatic charge of the toner; and a conveyance mechanism which is adapted to convey the toner to the development area and to collect the opposite polarity particles back into the developer tank, wherein the relative dielectric constant of the opposite polarity particles is no less than 6.7 at 25° C.

DETAILED DESCRIPTION OF THE PREFERRED EMBODIMENT

The following describes the embodiments of the present invention with reference to drawings:

First Embodiment

Figure 1:
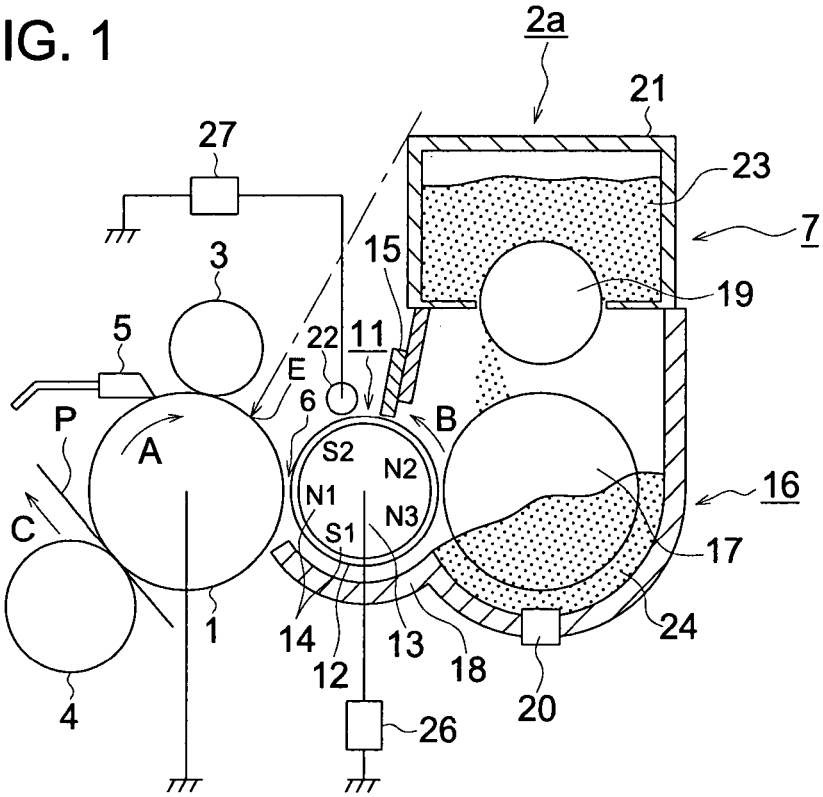
FIG. 1 is a schematic diagram showing the major portion of a development apparatus and image forming apparatus as a first embodiment of the present invention.

FIG. 1 is a schematic diagram showing the major portion of an image forming apparatus as a first embodiment of the present invention. This image forming apparatus is a printer wherein the toner image formed on an image carrier 1 by the electrophotographic technology is transferred onto the transfer medium P such as paper, whereby an image is formed. This image forming apparatus has the image carrier 1 for carrying an image. A charging apparatus 3 as a charging device for charging the image carrier 1, a development apparatus 2*a* for developing the electrostatic latent image on the image carrier 1, a transfer roller 4 for transferring a toner image on the image carrier 1 and a cleaning blade 5 for removing the residual toner from the image carrier 1 are sequentially arranged around the image carrier 1 in the rotational direction A of the image carrier 1.

After having been charged by the charging apparatus 3, the image carrier 1 is exposed to light by the exposure apparatus equipped with the laser light emitting device at the position E of the drawing, and an electrostatic latent image is formed on the surface. The development apparatus 2*a* develops this electrostatic latent image into the toner image. After having transferred the toner image on this image carrier 1 to the transfer medium P, the transfer roller 4 ejects it in the C-marked direction of the drawing. Subsequent to the transfer, the cleaning blade 5 uses the mechanical force to remove the residual toner on the image carrier 1. The image carrier 1, charging apparatus 3, exposure apparatus, transfer roller 4 and cleaning blade 5 used in the image forming apparatus can use any of the conventional electrophotographic methods. For example, a charging roller is shown as a charging device in the drawing. However, it is also possible to use a charging apparatus not in contact with the image carrier 1. Further, a cleaning blade, for example, does not need to be used.

In this embodiment, the development apparatus 2*a* includes a developer tank 16 for storing a developer 24, a developer supporting member 11 for conveying the developer 24 supplied from the developer tank by carrying it on the surface thereof, and a separation member for separating the opposite polarity particles from the developer on the developer supporting member. The opposite polarity particles are collected and stored into the developer tank 16. This arrangement controls the consumption of the opposite polarity particles. Moreover, the opposite polarity particles ensure effective compensation for the charging property of the carrier, with the result that the deterioration of the carrier can be reduced for a long time. Thus, electrostatic charge of toner can be maintained effectively for a long time, even in the case of continuous formation of the image having a smaller image area ratio.

If the development apparatus does not have the aforementioned separation member, the effect of reducing the carrier deterioration is decreased in the development apparatus especially when the image area ratio is small. This phenomenon is considered to be caused by the following mechanism: In the two-component developing apparatus, electric field of vibration is applied in the development area to form a strong electric field, thereby improving the separability of toner from the carrier in the developer. The carrier, toner and opposite polarity particles are separated when using the developer including the opposite polarity particles. Although the carrier remains on the developer supporting member due to magnetic attraction, toner is consumed by the image portion of the electrostatic latent image, while the opposite polarity particles are consumed by the non-image portion. Thus, the balance of consumption between toner and opposite polarity particles is not stabilized due to the variety of the image area ratio. Especially when a great number of images having a greater background area have been printed, the opposite polarity particles in the developer are consumed on a priority basis. Thus, the charging property of the carrier cannot be compensated for, and the effect of reducing carrier deterioration is decreased.

The developer 24 in the present embodiment includes the toner, the carrier for charging this toner and opposite polarity particles. The opposite polarity particles are charged oppositely to toner in terms of the charging polarity in the developer. It contains the particles having a relative dielectric constant being equal to or greater than 6.7. The relative dielectric constant is only required to be equal to or greater than 6.7. If the object of the present invention can be achieved, there is no restriction to the upper limit. Such opposite polarity particles are contained in the two-component developer. The opposite polarity particles in the developer are accumulated with the increasing number of printed sheets by the separation member. Thus, even if the toner or finishing agent are deposited (as spent matters) on the carrier surface and the charging property of the carrier is reduced, the opposite polarity particles are deposited onto the carrier surface, whereby toner is triboelectrically charged. This will provide the effect of compensating for reduction in the charge-applying property of the carrier due to the increasing number of printed sheets. Thus, the toner is charged to a predetermined level of electrostatic charge, and effective compensation for carrier deterioration can be achieved.

The opposite polarity particles are deposited on the carrier surface in the developer tank by mixing and agitation. The amount of this deposition is preferably 0.01 through 0.1% by mass with respect to carrier mass. Then more stable electrostatic charge of toner can be obtained by adequate compensation for reduction in the electrostatic charge of toner resulting from the carrier deterioration.

To control the amount of deposition of the opposite polarity particles on the carrier surface, it is preferable to supply a supplemental toner to the development apparatus, the supplemental toner on the surface of which opposite polarity particles are deposited in advance by mixing a predetermined amount of opposite polarity particles. 0.2 through 4% by mass of the opposite polarity particles with respect to toner mass, deposited on this supplemental toner, having a diameter of 0.2 through 0.6 μm are preferably deposited on the toner surface. This arrangement permits uniform supply of the toner and opposite polarity particles into the developer tank. Further, particles having a diameter of 0.2 through 0.6 μm ensure easy separation of the opposite polarity particles from the toner surface by the separation member. The separated opposite polarity particles having a particle diameter of 0.2 through 0.6 μm are returned to the developer tank and are blended with the carrier and stirred in the developer tank, whereby the particles are deposited on the carrier surface. The opposite polarity particles deposited on the carrier surface compensate for the carrier deterioration resulting from an increasing number of printed sheets, and maintain the satisfactory charging property of the toner. The opposite polarity particles having a diameter of less than 0.2 μm cannot ensure easy separation from the toner surface by the separation member. The opposite polarity particles having a diameter of more than 0.6 μm cannot be easily deposited on the carrier surface.

The amount of deposition of the opposite polarity particles on carrier surfaces can be also controlled by adjusting the stirring conditions of the developer tank (the amount of the developer in the developer tank, the rotation speed of the stirring member, etc.), the separation condition by the separation member (separation voltage condition, and gap between the separation member and developer supporting member), and physical properties on the carrier surface. Other factors related to the amount of deposition can be used if any.

(Opposite Polarity Particles)

The opposite polarity particles to be used preferably is selected from among the materials to be charged oppositely to that of the toner. For example, it is possible to use inorganic particles of strontium titanate and barium titanate. It is also possible to treat the surface so as to provide negative or positive charging. Alternatively, a plurality of types of these particles can be mixed for use. In this case, it is preferable for the mixture to include the particles having a relative dielectric constant equal to or greater than 6.7.

To control the charging property and hydrophobic property of the opposite polarity particles, the surface of the inorganic particles can be treated by a silane coupling agent, titanium coupling agent, silicone oil or the like. When inorganic particles are positively charged, it is preferred to treat the surface with a coupling agent containing an amino group. When inorganic particles are negatively charged, it is preferred to treat the surface with a coupling agent containing a fluorine group.

The number average particle diameter of the opposite polarity particles is preferably 100 through 1000 nm.

(Toner)

There is no restriction to the toner to be used. It is possible to use the conventional toner commonly put into general use. The binder resin can contain a coloring agent and, if required, an electric charge controlling agent or mold releasing agent, or can be treated with an external additive agent. The toner particle diameter is not restricted to the aforementioned size. The preferred diameter is about 3 through 15 μm.

Such toner can be manufactured according to the conventional method commonly put into general use. For example, toner can be used according to the pulverization method, emulsion polymerization method, suspension polymerization method or the like.

The binder resin used for toner is not restricted to the aforementioned ones. For example, it is possible to use the styrene resin (a single polymer or copolymer including styrene or substituted styrene), polyester resin, epoxy resin, polyvinyl chloride resin, phenol resin, polyethylene resin, polypropylene resin, polyurethane resin and silicone resin. These resins are used independently or in combination, and are preferred to have a softening temperature of 80 through 160° C. or a glass transition point of 50 through 75° C.

A commonly used conventional coloring agent can be used as the coloring agent. For example, it is possible to use carbon black, aniline black, activated carbon, magnetite, benzine yellow, permanent yellow, naphthol yellow, phthalocyanine blue, first sky blue, ultra marine blue, rose bengal, lake red and others. Generally, 2 through 20 parts by mass of coloring agent is preferably used with respect to 100 parts by mass of the aforementioned binder resin.

As the aforementioned electric charge controlling agent, it is possible to use the conventional agent commonly put into practical use. The electric charge controlling agent for positively charged toner is exemplified by nigrosine dye, quaternary ammonium salt compound, triphenylmethane compound, imidazole based compound, polyamine resin. The electric charge controlling agent for negative charged toner is exemplified by azo dyes containing such metals as Cr, Co, Al and Fe, salicylic acid metal compound, alkyl salicylic acid metal compound, and Kerlix arene compound. Generally, 0.1 through 10 parts by mass of the electric charge controlling agent is preferably used with respect to 100 parts by mass of the aforementioned binder resin.

A commonly used conventional mold releasing agent can be used as the aforementioned mold releasing agent. For example, polyethylene, polypropylene, carnauba wax and sazole wax can be used independently or in combination. Generally, 0.1 through 10 parts by mass of the mold releasing agent is preferably used with respect to 100 parts by mass of the aforementioned binder resin.

A commonly used conventional additive agent can be used as the aforementioned external additive agent. It is possible to use a superplasticizer as exemplified by inorganic particles such as silica, titanium oxide and aluminum oxide, and the resin particles such as acryl resin, styrene resin, silicone resin, and fluorine resin. It is particularly preferred to use the silane coupling agent, titanium coupling agent or silicon oil having been hydrophobed. 0.1 through 5 parts by mass of such a superplasticizer should be added to 100 parts by mass of toner. The number average particle diameter of the external additive agent is preferably 10 through 100 nm.

(Carrier)

There is no particular restriction to the carrier. A commonly used conventional carrier can be used. For example, a binder type carrier and coating type carrier can be used. Although there is no particular restriction, the carrier particle diameter is preferably 15 through 100 μm.

The binder type carrier is made up of the magnetic particles dispersed in the binder resin. Positive or negative electrostatic particles can be deposited onto the carrier surface, or a surface coating layer can be provided. The charging characteristics of the binder type carrier such as polarity can be controlled according to the material of the binder resin, electrostatic particles, and type of the surface coating layer.

The binder resin used in the binder type carrier is exemplified by a vinyl resin represented by a polystyrene resin, a thermoplastic resin such as a polyester resin, nylon resin and polyolefin resin, and a curable resin such as a phenol resin.

The magnetic particles of the binder type carrier that can be used are exemplified by the particles made of: magnetite; spinel ferrite such as gamma iron oxide; spinel ferrite containing one or more metals other than iron (Mn, Ni, Mg, Ci, etc.); magnetoplumbite-type ferrite such as barium ferrite; and iron containing an oxide layer on the surface, and the alloy thereof. These particles can be granular, spherical or acicular. Especially when a high degree of magnetism is required, use of iron-based ferromagnetic particles is preferred. When chemical stability is taken into account, ferromagnetic particles of magnetoplumbite-type ferrite such as spinel ferrite and barium ferrite containing magnetite and gamma iron oxide are preferably used. A magnetic resin carrier of a desired magnetism can be obtained by properly selecting the type and the amount of ferromagnetic particles contained. 50 through 90% by mass of these magnetic particles are preferably added in the magnetic resin carrier.

Silicone resin, acryl resin, epoxy resin and fluorine resin are used as the surface coating material of the binder type carrier. These resins are coated on the surface and are cured to form a coating layer, whereby the charge-applying property is enhanced.

Deposition of the electrostatic particles or conductive particles on the surface of the binder type carrier is carried out, for example, by uniform mixing of the magnetic resin carrier and particles, followed by the process of these particles being deposited on the surface of the magnetic resin carrier and the process of applying mechanical and thermal impact, whereby the particles are driven into the magnetic resin carrier and are fixed in position. In this case, without being embedded completely into the magnetic resin carrier, the particles are partly protruded from the magnetic resin carrier surface, and are secured in position. The electrostatic particles are made of organic or inorganic insulating material. To put it more specifically, the organic material that can be used includes the organic insulating particles of polystyrene, styrene copolymer, acryl resin, various types of acryl copolymers, nylon, polyethylene, polypropylene, fluorine resin and their cross-linked substance. A desired level and polarity of charging can be obtained by proper selection of the material and polymerization catalyst as well as surface treatment. The inorganic material that can be used includes the negative inorganic electrostatic particles such as silica and titanium dioxide, and positive inorganic electrostatic particles such as strontium titanate and alumina.

In the meantime, the coating type carrier is a carrier formed by coating a resin coating on the carrier core particles made of a magnetic substance. In the coating type carrier, similarly to the case of the binder type carrier, the positive or negative electrostatic particles can be deposited on the carrier surface. The charging properties of the coating type carrier such as polarity can be controlled by proper selection of the type of the surface coating layer and electrostatic particles. It is possible to use the same material as that of the binder type carrier. The same resin as the binder type carrier binder resin can be used as the coated resin in particular.

Figure 3:
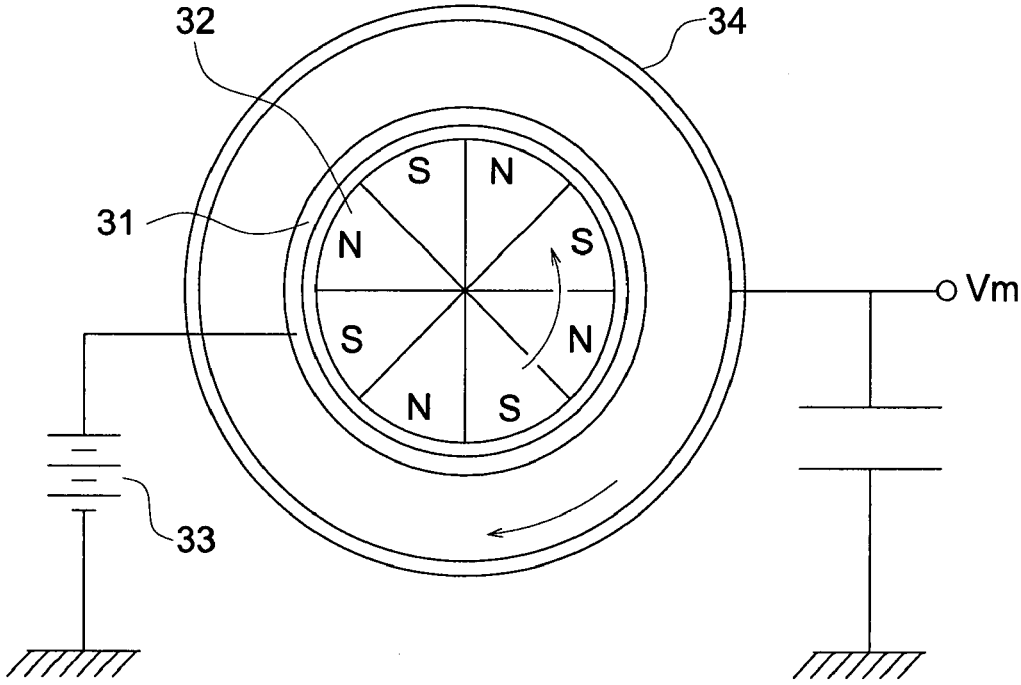
FIG. 3 is a schematic diagram showing an apparatus for measuring the amount of electrostatic charge of toner.

The charging polarity of the toner and the opposite polarity particles can be easily identified, when the opposite polarity particles, toner, and carrier are combined, from the direction for separating the toner or opposite polarity particles from the developer, using the apparatus of FIG. 3, after a developer has been formed by mixing and stirring the toner, carrier, and opposite polarity particles. In the first place, the developer is uniformly carried on the conductive sleeve 31 surface by the magnetic force of the magnet roll 32. After that, the cylindrical electrode 34 is arranged so that it does not come in contact with the developer. Then while voltage is applied to the metallic sleeve by the bias power source 33, the magnet roll 32 is rotated, whereby the particles having the same polarity as that of the applied voltage is splashed to the cylindrical electrode 34 by the electric field. This operation is carried out by changing the polarity of the voltage. Thus, the charging polarity of the toner or opposite polarity particles can be identified.

(Preparation of Developer)

The mixing ratio of the toner and carrier should be adjusted so as to get a desired level of electrostatic charge of toner. The toner ratio is preferably 3 through 50% by mass with respect to the total amount of the toner and carrier, more preferably 5 through 20% by mass, although it depends on the ratio of the surface area resulting from the difference between the particle diameters of the toner and carrier.

There is no particular restriction to the amount of the opposite polarity particles contained in the developer as long as the object of the present invention can be achieved. For example, 0.01 through 5.00 parts by mass, particularly 0.01 through 2.00 parts by mass is preferred with respect to 100 parts by mass of the carrier.

The developer can be prepared by mixing the toner with the carrier after the opposite polarity particles have been externally added to the toner in advance, for example.

The supplemental toner to the development apparatus is preferably the toner with opposite polarity particles added externally thereto in advance. In this case, a Henschel mixer, etc. can be used as an external addition apparatus.

(Development Apparatus 2*a*)

In the development apparatus 2*a*, the opposite polarity particle collecting member 22 for separating and collecting the opposite polarity particles from the developer on the developer supporting member 11 is adopted as the separation member for separating the opposite polarity particles from the developer on the developer supporting member 11. As shown in FIG. 1, the opposite polarity particle collecting member 22 is installed upstream from the development area 6 on the developer supporting member 11 in the traveling direction of the developer. By application of the opposite polarity particle separation bias, the opposite polarity particles in the developer are electrically separated and captured onto the surface of the opposite polarity particle collecting member 22. After the opposite polarity particles have been separated by the opposite polarity particle collecting member 22, the developer remaining on the developer supporting member 11—the toner and carrier—is continued to be conveyed, and the electrostatic latent image on the image carrier 1 is developed in the development area 6.

The opposite polarity particle collecting member 22 is connected to the power source 27 as an electric field forming mechanism, and a predetermined opposite polarity particle separation bias is applied. The developer supporting member 11 is connected to the power source 26. Then the opposite polarity particles in the developer are electrically separated and captured on the surface of the opposite polarity particle collecting member 22.

The opposite polarity particle separation bias applied to the opposite polarity particle collecting member 22 varies according to the charging polarity of the opposite polarity particles. To be more specific, when the toner is negatively charged and the opposite polarity particles are positively charged, it is the voltage wherein the average value is lower than that of the voltages applied to the developer supporting member; whereas, when the toner is positively charged and the opposite polarity particles are negatively charged, it is the voltage wherein the average value greater than that of the voltages applied to the developer supporting member. Independently of whether opposite polarity particles are charged positively or negatively, the difference between the average voltage applied to the opposite polarity particle collecting member and the average voltage applied to the developer supporting member is preferably 20 through 500 V, particularly 50 through 300 V. When the potential difference is too small, sufficient recovery of opposite polarity particles will be difficult. In the meantime, if the potential difference is too large, the carrier held on the developer supporting member by magnetic force is separated by the electric field, and the original development function may be lost in the development area.

In the development apparatus 2*a*, furthermore, AC electric field is preferably formed between the opposite polarity particle collecting member and developer supporting member. Formation of the AC electric field causes the toner to be vibrated back and forth, whereby the opposite polarity particles attached on the toner surface can be separated effectively, and the collectibility of opposite polarity particles is enhanced. In this case, the electric field equal to or greater than $2.5\times10^6$ V/m is preferably formed. When the electric field equal to or greater than $2.5\times10^6$ V/m is formed, opposite polarity particles can be separated from toner by electric field as well. This further enhances the separability and collectibility of the opposite polarity particles.

In this Specification, the electric field formed between the opposite polarity particle collecting member and developer supporting member is referred to as an opposite polarity particle separation electric field. This opposite polarity particle separation electric field can normally be obtained by application of AC voltage to the opposite polarity particle collecting member and/or developer supporting member. Especially when the AC voltage is applied to the developer supporting member in order to develop the electrostatic latent image by toner, the opposite polarity particle separation electric field is preferably formed using the AC voltage applied to the developer supporting member. In this case, the maximum value of the absolute value of the opposite polarity particle separation electric field should be within the aforementioned range.

For example, assume that the charging polarity of the opposite polarity particles is positive, the DC voltage and AC voltage are applied to the developer supporting member, and only the DC voltage is applied to the opposite polarity particle collecting member. In this case, only the DC voltage lower than the average value of the voltage (DC+AC) applied to the developer supporting member is applied to the opposite polarity particle collecting member. For example, assume that the charging polarity of the opposite polarity particles is negative, DC voltage and AC voltage are applied to the developer supporting member, and only the DC voltage is applied to the opposite polarity particle collecting member. In this case, only the DC voltage higher than the average value of the voltage (DC+AC) applied to the developer supporting member is applied to the opposite polarity particle collecting member. In such cases, the maximum value of the absolute value of the opposite polarity particle separation electric field is the value obtained by dividing the maximum value of the potential difference between the voltage (DC+AC) applied to the developer supporting member and the voltage (DC) applied to the opposite polarity particle collecting member, by the gap at the closest portion between the opposite polarity particle collecting member and developer supporting member. This value is preferably within the aforementioned range.

For example, assume that the charging polarity of the opposite polarity particles is positive, only the DC voltage is applied to the developer supporting member, and the AC voltage and DC voltage are applied to the opposite polarity particle collecting member. In this case, the DC voltage with the AC voltage superimposed thereto so as to get the average voltage lower than the DC voltage applied to the developer supporting member is applied to the opposite polarity particle collecting member. For example, assume that the charging polarity of the opposite polarity particles is negative, only the DC voltage is applied to the developer supporting member, and AC voltage and DC voltage are applied to the opposite polarity particle collecting member. In this case, the DC voltage with the AC voltage superimposed thereto so as to get the average voltage higher than the DC voltage applied to the developer supporting member is applied to the opposite polarity particle collecting member. In such cases, the maximum value of the absolute value of the opposite polarity particle separation electric field is the value obtained by dividing the maximum value of the potential difference between the voltage (DC) applied to the developer supporting member and the voltage (DC+AC) applied to the opposite polarity particle collecting member, by the gap at the closest portion between the opposite polarity particle collecting member and developer supporting member. This value is preferably within the aforementioned range.

For example, assume that the charging polarity of the opposite polarity particles is positive, and the DC voltage with AC voltage superimposed thereon is applied to both the developer supporting member and opposite polarity particle collecting member. In this case, the voltage (DC+AC) wherein the average voltage is smaller than the average value of the voltage (DC+AC) applied to the developer supporting member is applied to the opposite polarity particle collecting member. For example, assume that the charging polarity of the opposite polarity particles is negative, and the DC voltage with AC voltage superimposed thereon is applied to both the developer supporting member and opposite polarity particle collecting member. In this case, the voltage (DC+AC) wherein the average voltage is greater than the average value of the voltage (DC+AC) applied to the developer supporting member is applied to the opposite polarity particle collecting member. In such cases, the value obtained by dividing the maximum value of the potential difference, resulting from the difference in the amplitude, phase, frequency, duty ratio and others of the AC voltage component applied to each of them, between the voltage (DC+AC) applied to the developer supporting member and the voltage (DC+AC) applied to the opposite polarity particle collecting member, by the gap at the closest portion between the opposite polarity particle collecting member and developer supporting member is the maximum value of the absolute value of the opposite polarity particle separation electric field. This value is preferably within the aforementioned range.

The opposite polarity particles on the surface of this member separated and captured by the opposite polarity particle collecting member 22 is collected back into the developer tank 16. When opposite polarity particles are recollected to the developer tank from the opposite polarity particle collecting member, it is only required to reverse the relationship of magnitude between the average value of the voltage applied to the opposite polarity particle collecting member and the average value of the voltage applied to the developer supporting member. This procedure can be taken before starting image formation or after termination of image formation. It can also be taken at the timing of forming non-images such as a space between sheets between image formation operations (space between the previous and succeeding pages) during continuous operation.

The opposite polarity particle collecting member 22 can be made of any material so long as the aforementioned voltage can be applied. It is exemplified by the aluminum roller provided with surface treatment. For example, the upper surface of the conductive substance such as aluminum can be coated with such resins as polyester resin, polycarbonate resin, acryl resin, polyethylene resin, polypropylene resin, urethane resin, polyamide resin, polyimide resin, polysulfone resin, polyether ketone resin, polyvinyl chloride resin, vinyl acetate resin, silicone resin and fluorine resin, or can be coated with such rubbers as silicone rubber, urethane rubber, nitrile rubber, natural rubber, isoprene rubber. Without the coating material being restricted thereto, a conductive agent can be further added to the bulk and surface of the aforementioned coating. The conductive agent is exemplified by an electron conductive agent or ion conductive agent. The electron conductive agent is exemplified by the carbon black such as kechin black, acetylene black and furnace black, and particles such as metallic powder and metallic oxide, without being restricted thereto. The ion conductive agent is exemplified by the cationic compound such as quaternary ammonium salt, amphoteric compound and other ionic high molecular materials, without being restricted thereto. Further, a conductive roller made up of metal material such as aluminum.

The developer supporting member 11 is made up of a magnetic roller 13 located at a fixed position and a freely rotatable sleeve roller 12 including the same. The magnetic roller 13 has five magnetic poles—N1, S1, N3, N2 and S2 in the rotational direction B of the sleeve roller 12. Of these magnetic poles, the main magnetic pole N1 is located in the development area 6 facing the image carrier 1. Further, the poles N3 and N2 are arranged face to face with each other inside the development tank 16, wherein the poles N3 and N2 generate the repellent magnetic field to separate the developer 24 on the sleeve roller 12.

The developer tank 16 is made of a casing 18. It normally incorporates a bucket roller 17 to supply developer to the developer supporting member 11. An ATDC (Automatic Toner Density Control) sensor 20 for detecting the toner density is preferably arranged face to face with the bucket roller 17 of the casing 18.

The development apparatus 2*a* normally has a supply section 7 for supply into the developer tank 16 as much toner as consumed in the development area 6, and a regulating member (regulating blade) 15 for forming a thin layer of developer to regulate the amount of developer on the developer supporting member 11. The supply section 7 is made up of a hopper 21 for storing a supplemental toner 23, and a supply roller 19 for supplying the toner to the developer tank 16.

The toner with opposite polarity particles externally added thereto is preferably used as the supplemental toner 23. Use of the toner with opposite polarity particles externally added thereto effectively compensate for the reduction of the charging property of the carrier that is gradually deteriorated with use.

In the development apparatus 2*a* shown in FIG. 1, the developer 24 in the developer tank 16 is mixed and stirred by rotation of the bucket roller 17. After having been subjected to triboelectric charging, the developer is scooped up by the bucket roller 17, and is supplied to the sleeve roller 12 on the surface of the developer supporting member 11. This developer 24 is maintained on the surface side of the sleeve roller 12 by the magnetic force of the magnetic roller 13 inside the developer supporting member (development roller) 11, and is rotated together with the sleeve roller 12. The amount of the developer passing through is regulated by the regulating member 15 provided face to face with the development roller 11. After that, in the position opposed to the opposite polarity particle collecting member 22, only the opposite polarity particles contained in the developer is separated and captured by the opposite polarity particle collecting member, as described above. The remaining developer separated from the opposite polarity particles is conveyed to the development area 6 facing the image carrier 1. In the development area 6, the brush of the developer is formed by the magnetic force of the main magnetic pole N1 of the magnetic roller 13. The toner in the developer is transferred to the electrostatic latent image on the image carrier 1 by the force applied to the toner by the electric field between the electrostatic latent image on the image carrier 1 and the development roller 11 to which development bias is applied, whereby the electrostatic latent image is developed into an visible image. The development can be made by the reversal development method or normal development method. In the development area 6, the developer 24 having consumed toner is conveyed to the developer tank 16. It is separated from the developer supporting member 11 by the repellent magnetic field of the poles N3 and N2 of the magnetic roller provided face to face with the bucket roller 17, and is collected into the developer tank 16. According to the output value of the ATDC sensor 20, the supply control section (not illustrated) arranged on the supply section 7 detects that the toner density in the developer 24 has been reduced below the minimum toner density for maintaining the image density, and sends a drive start signal to the drive section of the toner supply roller 19. Then the toner supply roller 19 starts to rotate. This rotation causes the supplemental toner 23 stored in the hopper 21 to be supplied into the developer tank 16. In the meantime, the opposite polarity particles captured by the opposite polarity particle collecting member 22 are returned onto the development roller by reversing the direction of the electric field applied to the development roller and opposite polarity particle collecting member at the time of formation of the non-image. Then these opposite polarity particles are conveyed together with the developer by the rotation of the development roller and are returned to the developer tank.

In FIG. 1, the opposite polarity particle collecting member 22 is provided separately from the regulating member 15 and casing 18. The opposite polarity particle collecting member can serves as at least one of the regulating member 15 and casing 18. To be more specific, at least one of the regulating member 15 and casing 18 can be used as the opposite polarity particle collecting member. In this case, the opposite polarity particle separation bias should be applied to the regulating member 15 and casing 18. This arrangement ensures a reduced space and cost.

In the development apparatus 2*a*, not all the opposite polarity particles have to be collected by the opposite polarity particle collecting member. Part of the opposite polarity particles, without being collected, can be consumed for development together with toner. Other opposite polarity particles are collected and the opposite polarity particles are replenished. This provides the effect of assisting the carrier charging by the opposite polarity particles, even if the opposite polarity particles are not completely collected.

Second Embodiment

Figure 2:
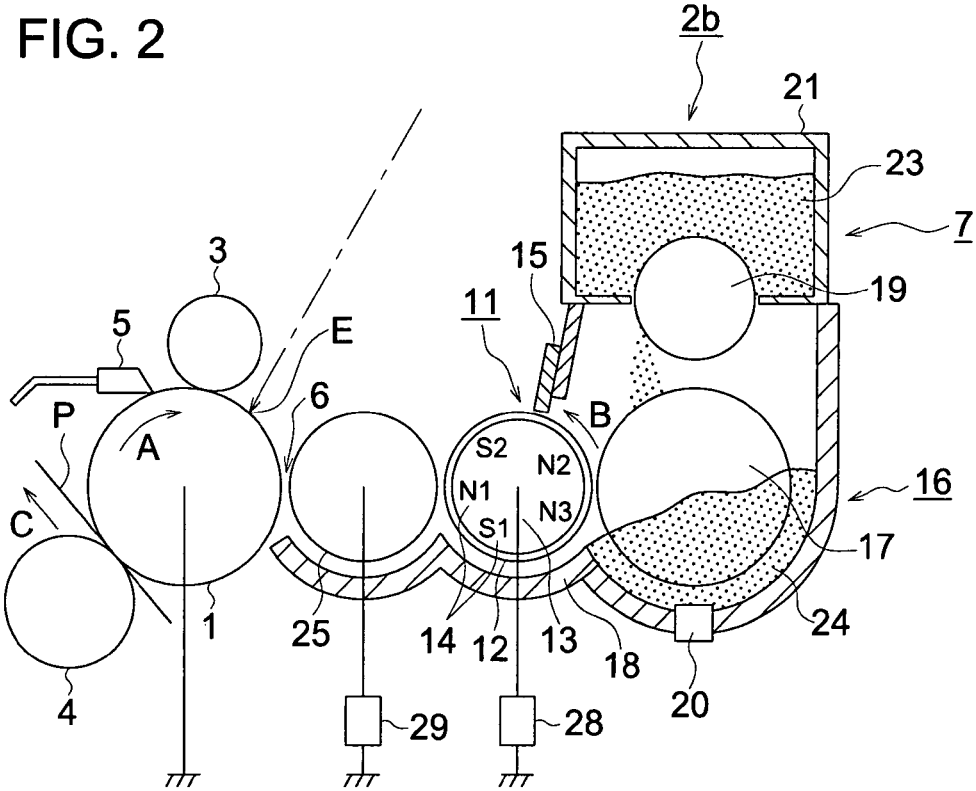
FIG. 2 is a schematic diagram showing the major portion of a development apparatus and image forming apparatus as a second embodiment of the present invention.

Referring to FIG. 2, the following describes the major part of the image forming apparatus as a second embodiment of the present invention: The members of FIG. 2 having the same functions as those of FIG. 1 are assigned with the same numerals as those of FIG. 1, and will not be described to avoid duplication.

The development apparatus 2*b* shown in FIG. 2 adopts the toner-supporting member 25 for separating and carrying the toner from the developer on the developer supporting member 11 as a separation member for separating toner from the developer of the developer supporting member 11, instead of the opposite polarity particle collecting member 22 shown in FIG. 1. As shown in FIG. 2, the toner-supporting member 25 is provided between the developer supporting member 11 and image carrier 1. The toner in the developer is electrically separated and carried on the toner-supporting member surface when toner separation bias is applied. The toner separated and carried by the toner-supporting member 25 is conveyed by the toner-supporting member 25, and develops the electrostatic latent image on the image carrier 1 in the development area 6.

As described above, in the development apparatus 2*b*, unlike the embodiment shown in FIG. 1, toner is separated from the developer and is carried by the toner-supporting member 25, without the developer being separated from the opposite polarity particles, and the toner separated and carried by this toner-supporting member 25 is used to develop the electrostatic latent image on the image carrier 1.

In the second embodiment, the same developer 24 as that in the first embodiment is used. To be more specific, the developer 24 contains toner, carrier for charging the toner, and opposite polarity particles. The opposite polarity particles in the developer are charged oppositely to the toner, and contain the particle having a relative dielectric constant equal to or greater than 6.7. The relative dielectric constant is only required to be equal to or greater than 6.7. There is no restriction to the upper limit so long as the object of the present invention can be achieved. Such opposite polarity particles are included in the two-component developer, and opposite polarity particles are accumulated in the developer by the separation member with the increasing number of printed sheets. Thus, even if the toner and finishing agent are deposited (as spent matters) on the carrier surface and the charging property of the carrier is reduced, toner is triboelectrically charged since the opposite polarity particles are deposited onto the carrier surface. This will adequately provide the effect of compensating for reduction in the charge-applying property of the carrier due to the increasing number of printed sheets. Thus, the toner is charged to a predetermined level of electrostatic charge, and effective compensation for carrier deterioration can be achieved.

Opposite polarity particles are deposited on the surface of the carrier in the developer tank by mixing and stirring. The amount of this deposition is preferably 0.01 through 0.1% by mass with respect to the mass of the carrier. This range adequately compensates for the reduction in the electrostatic charge of the toner resulting from carrier deterioration and ensures more stable electrostatic charge of the toner.

To control the amount of the opposite polarity particles deposited on the carrier surface, it is preferred that the toner to be supplied to the development apparatus should be mixed with a predetermined amount of opposite polarity particles in advance, and the supplemental toner on the surface of which adequate opposite polarity particles are deposited should be used. 0.2 through 4% by mass of the opposite polarity particles with respect to the amount of toner have a diameter of 0.2 through 0.6 μm and are preferably deposited to the surface of the supplemental toner. This arrangement permits uniform supply of the toner and opposite polarity particles to the developer tank. The opposite polarity particles having a diameter of 0.2 through 0.6 μm are more easily separated from the toner surface by the separation member. The separated opposite polarity particles having a diameter of 0.2 through 0.6 μm are returned to the developer tank and are mixed and stirred with the carrier in the developer tank, whereby these particles are deposited thereon. The opposite polarity particles deposited on the surface of the carrier compensate for the carrier deterioration resulting from the increasing number of printed sheets, whereby the charging property of the toner is maintained. If the opposite polarity particles have a diameter of less than 0.2 μm, they cannot easily be separated from the surface of the toner by the separation member. If the diameter exceeds 0.6 μm, opposite polarity particles cannot easily be deposited on the surface of the carrier.

The amount of the opposite polarity particles deposited on the surface of carrier can be also controlled by adjusting the stirring conditions in the developer tank (the amount of the developer in the developer tank, the rotation speed of the stirring member, etc.), the condition of separation by the separation member (condition of separation voltage, gap between the separation member and developer supporting member, etc.) and physical properties on the surface of the carrier. Other factors than these conditions can be used if they are related to the amount of deposition. The details of the developer 24 are the same as those described with reference to the embodiment 1, and will not be described to avoid duplication.

(Development Apparatus 2*b*)

In the development apparatus 2*b*, the toner-supporting member 25 is connected to the power source 29 as an electric field forming mechanism, and a predetermined toner separation bias is applied thereto. The developer supporting member 11 is connected to the power source 28. Thus, the toner in the developer is electrically separated and carried on the surface of the toner-supporting member 25.

The toner separation bias applied to the toner-supporting member 25 varies according to the toner charging polarity. To be more specific, when toner is negatively charged, it is the voltage wherein the average value is higher than that of the voltage applied to the developer supporting member. When toner is positively charged, it is the voltage wherein the average value is lower than that of the voltage applied to the developer supporting member. Even when the toner is charged either positively or negatively, the difference between the average voltages applied to the toner-supporting member and that applied to the developer supporting member is preferably 20 through 500 V, more preferably 50 through 300 V. If the potential difference is too small, the amount of toner on the toner-supporting member is insufficient so that sufficient image density cannot be obtained. On the other hand, if the potential difference is too large, potential difference is excessive so that excessive toner is supplied, with the result that unwanted toner consumption may increase.

In the development apparatus 2*b*, an AC electric field is preferably formed between the toner-supporting member and developer supporting member. Formation of the electric field causes the toner to be vibrated back and forth, thereby ensuring effective separation between the toner and opposite polarity particles. In this case, the electric field to be formed is preferably $2.5\times10^6$ V/m or more without exceeding $5.5\times10^6$ V/m. Formation of the electric field equal to or greater than $2.5\times10^6$ V/m allows the opposite polarity particles to be separated from toner by the electric field as well. This signifies a further improvement in the separability of toner. If the electric field is equal to or greater than $5.5\times10^6$ V/m, leakage will occur between the toner-supporting member and developer supporting member. This is not preferred.

In the present Specification, the electric field formed between the toner-supporting member and developer supporting member is referred to as a toner separation electric field. Such a toner separation electric field is normally obtained by applying AC voltage to the toner-supporting member and/or developer supporting member. Especially when AC is applied to the toner-supporting member to develop the electrostatic latent image with toner, toner separation electric field is preferably formed using the AC voltage applied to the toner-supporting member. In this case, the maximum value of the absolute value of the toner separation electric field is only required to be the aforementioned range.

For example, assume that the charging polarity of the toner is positive, the DC voltage and AC voltage are applied to the developer supporting member, and only the DC voltage is applied to the toner supporting member. In this case, only the DC voltage lower than the average value of the voltage (DC+AC) applied to the developer supporting member is applied to the toner supporting member. For example, assume that the charging polarity of the toner is negative, the DC voltage and AC voltage are applied to the developer supporting member, and only the DC voltage is applied to the toner supporting member. In this case, only the DC voltage higher than the average value of the voltage (DC+AC) applied to the developer supporting member is applied to the toner supporting member. In such cases, the maximum value of the absolute value of the toner separation electric field is the value obtained by dividing the maximum value of the potential difference between the voltage (DC+AC) applied to the developer supporting member and the voltage (DC) applied to the toner carrier, by the gap at the closest portion between the toner supporting member and developer supporting member. This value is preferably within the aforementioned range.

For example, assume that the charging polarity of the toner is positive, only the DC voltage is applied to the developer supporting member, and the DC voltage and AC voltage are applied to the toner supporting member. In this case, the DC voltage with the AC electric field superimposed thereon so as to get average voltage lower than the DC voltage applied to the developer supporting member is applied to the toner supporting member. For example, assume that the charging polarity of the toner is negative, only the DC voltage is applied to the developer supporting member, and the DC voltage and AC voltages are applied to the toner supporting member. In this case, the DC voltage with the AC electric field superimposed thereon so as to get average voltage higher than the DC voltage applied to the developer supporting member is applied to the toner supporting member. In such cases, the maximum value of the absolute value of the toner separation electric field is the value obtained by dividing the maximum value of the potential difference between the voltage (AC) applied to the developer supporting member and the voltage (DC+AC) applied to the toner carrier, by the gap at the closest position between the toner supporting member and developer supporting member. This value is preferably within the aforementioned range.

For example, assume that the charging polarity of the toner is positive, and the DC voltage with AC voltage superimposed thereon is applied to both the developer supporting member and the toner supporting member. In this case, the voltage (DC+AC) wherein the average voltage is smaller than that of the voltage (DC+AC) applied to the developer supporting member is applied to the toner-supporting member. For example, assume that the charging polarity of the toner is negative, and the DC voltage with AC voltage superimposed thereon is applied to both the developer supporting member and the toner supporting member. In this case, the voltage (DC+AC) wherein the average voltage is greater than that of the voltage (DC+AC) applied to the developer supporting member is applied to the toner-supporting member. In such cases, the value obtained by dividing the maximum value of the potential difference, resulting from the difference in the amplitude, phase, frequency, duty ratio and others of the AC voltage component applied to each of them, between the voltage (DC+AC) applied to the developer supporting member and the voltage (DC+AC) applied to the toner supporting member, by the gap at the closest portion between the toner supporting member and developer supporting member is the maximum value of the absolute value of the toner supporting member separation electric field. This value is preferably within the aforementioned range.

The developer remaining on the developer supporting member 11 from which toner is separated by the toner-supporting member 25, namely, the carrier and opposite polarity particles are conveyed directly by this developer supporting member 11 and is collected back into the developer tank 16. In this embodiment, the opposite polarity particles are conveyed directly by the developer supporting member 11 and is collected back into the developer tank by the developer supporting member 11. This arrangement makes it possible to eliminate the step of returning the opposite polarity particles captured by the opposite polarity particle collecting member described in the embodiment of FIG. 1 back into the developer tank at the time of non-image formation.

The toner-supporting member 25 can be made of any material so long as the aforementioned voltage can be applied. It is exemplified by the aluminum roller provided with surface treatment. For example, the upper surface of the conductive substance such as aluminum can be coated with such resins as polyester resin, polycarbonate resin, acryl resin, polyethylene resin, polypropylene resin, urethane resin, polyamide resin, polyimide resin, polysulfone resin, polyether ketone resin, polyvinyl chloride resin, vinyl acetate resin, silicone resin and fluorine resin, or can be coated with such rubbers as silicone rubber, urethane rubber, nitrile rubber, natural rubber, isoprene rubber. Without the coating material being restricted thereto, a conductive agent can be further added to the bulk and surface of the aforementioned coating. The conductive agent is exemplified by an electron conductive agent or ion conductive agent. The electron conductive agent is exemplified by the carbon black such as kechin black, acetylene black and furnace black, and particles such as metallic powder and metallic oxide, without being restricted thereto. The ion conductive agent is exemplified by the cationic compound such as quaternary ammonium salt, amphoteric compound and other ionic high molecular materials, without being restricted thereto. Further, a conductive roller made up of metal material such as aluminum.

Similarly to the case of the development apparatus 2*a*, in the development apparatus 2*b* shown in FIG. 2, the developer 24 in the developer tank 16 is mixed and stirred by rotation of the bucket roller 17. After having been subjected to triboelectric charging, the developer is scooped up by the bucket roller 17, and is supplied to the sleeve roller 12 on the surface of the developer supporting member 11. This developer 24 is maintained on the surface side of the sleeve roller 12 by the magnetic force of the magnetic roller 13 inside the developer supporting member (development roller) 11, and is rotated together with the sleeve roller 12. The amount of the developer passing through is regulated by the regulating member 15 provided face to face with the development roller 11. After that, in the position opposed to the toner-supporting member 25, only the toner contained in the developer is separated and captured by the toner-supporting member 25, as described above. The toner having been separated is conveyed to the development area 6 facing the image carrier 1. In the development area 6, the toner on the toner-supporting member 25 is transferred to the electrostatic latent image of the image carrier 1 by the force applied to the toner by the electric field formed between the electrostatic latent image on the image carrier 1 and the toner-supporting member with the development bias applied thereto, whereby the electrostatic latent image is developed into a visible image. The development can be made by the reversal development method or normal development method. The toner layer on the toner-supporting member having passed the development area 6 is returned to the development area after having been supplied and collected by the magnetic brush where the toner-supporting member and the developer supporting member located face to face with each other. In the meantime, the developer remaining on the developer supporting member 11 from which the toner is separated is conveyed directly to the developer tank 16, and is separated from the developer supporting member 11 by the repellent magnetic field of the poles N3 and N2 of the magnetic roller arranged face to face with the bucket roller 17. It is then collected back into the developer tank 16. Similarly to the case of FIG. 1, the supply control section (not illustrated) arranged in the supply section 7 detects that the toner density in the developer 24 has been reduced below the minimum toner density for maintaining the image density, and sends a drive start signal to the drive section of the toner supply roller 19. The supplemental toner 23 is supplied into the developer tank 16.

In the development apparatus 2*b*, not all the opposite polarity particles have to remain on the side of the developer supporting member 11 by the electric field between the toner-supporting member 25 and developer supporting member 11. Part of the opposite polarity particles together with toner are allowed to shift to the toner-supporting member 25 so as to be supplied and consumed for development. The opposite polarity particles of other parts are collected and the opposite polarity particles are also replenished. Accordingly, even if the opposite polarity particles are not completely collected, the effect of assisting the charging of the carrier is provided by opposite polarity particles.

In the development apparatus of the embodiments using toner, carrier, and opposite polarity particles charged oppositely to the toner, the opposite polarity particles contain particles having a relative dielectric constant equal to or greater than 6.7, thereby ensuring adequate deposition of the opposite polarity particles to the surface of the carrier, even when toner and finishing agent are attached to the surface of the carrier and are changed into spent matter with the increasing number of prints. Triboelectric charging of these opposite polarity particles and toner compensates for reduction in the electrostatic charge of toner resulting from deterioration of the carrier that has raised a problem in the conventional two-component developing system. This arrangement compensates for reduction in the electrostatic charge of toner resulting from deterioration of the carrier, and hence, provides an image forming apparatus cable of ensuring a stable electrostatic charge of toner for a long time, and forming high-quality images.

EXAMPLE

The following describes the examples of the present invention:

1. Development Apparatus A

A development apparatus of FIG. 1 was used as the development apparatus A. A development bias of rectangular wave having an amplitude 1.4 kV, a DC component of −400 V, a duty ratio of 50% and a frequency of 2 kHz was applied to the developer supporting member. A DC bias of −550 V having a potential difference of −150 V with respect to the average potential of the development bias and a potential difference of 850 V with respect to the maximum potential of the development bias was applied to the opposite polarity particle collecting member. An aluminum roller with alumite treatment provided on its surface was used as the opposite polarity particle collecting member. The gap at the closest position between the developer supporting member and opposite polarity particle collecting member was 0.3 mm. The potential of the background of the electrostatic latent image formed on the image carrier was −550 V, and that of the image portion was −60 V. The gap at the closest position between the image carrier and developer supporting member was 0.35 mm. The maximum value of the absolute value of the opposite polarity particle separation electric field formed between the opposite polarity particle collecting member and developer supporting member was 850 V/0.3 mm=$2.8\times10^6$ V/m. The opposite polarity particles captured by the opposite polarity particle collecting member was collected back into the developer tank by reversing the voltage applied to the developer supporting member and opposite polarity particle collecting member at the timing between papers.

2. Development Apparatus B

A development apparatus of FIG. 2 was used as the development apparatus B. A −400 V DC voltage was applied to the developer supporting member. The development bias of rectangular wave having an amplitude of 1.6 kV, a DC component of −300 V, a duty ratio of 50%, and a frequency of 2 kHz was applied to the toner-supporting member. The average potential of the toner-supporting member had a potential difference of 100 V with respect to the potential of the developer supporting member, and the maximum potential difference was 900 V. The aluminum roller with alumite treatment provided on the surface was used as the toner-supporting member. The gap at the closest position between the developer supporting member and toner-supporting member was 0.3 mm. The potential of the background of the electrostatic latent image formed on the image carrier was −550 V, and the potential of the image portion was −60 V. The gap at the closest position between the image carrier and toner-supporting member was 0.15 mm. The maximum value of the absolute value of the toner separation electric field formed between the toner-supporting member and developer supporting member was 900 V/0.3 mm=$3.0\times10^6$ V/m.

3. Conditions of Externally Adding Process of the Opposite Polarity Particles and the Toner Table 1 shows the conditions of processing toner samples 1 through 19 prepared by externally adding the opposite polarity particles to the toner. In the first place, 100% by mass of the toner base material having diameter of about 6.5 μm prepared by the wet type granulating method was surface-treated at a speed of 40 m/s for three minutes using a Henschel mixer (by Mitsui Mining and Smelting Co., Ltd.), in the first external addition, wherein 0.2% by mass of the first hydrophobic silica, 0.5% by mass of the second hydrophobic silica, and 0.5% by mass of hydrophobic titanium oxide was used as a superplasticizer. The first hydrophobic silica in this case was the silica having an average primary particle diameter of 16 nm which was treated by the hexamethyl disilazane (HMDS) as a hydrophobing agent, and was surface-treated. Further, the second hydrophobic, silica was the silica having an average primary particle diameter of 20 nm which was surface treated by HMDS. The hydrophobic titanium oxide was the anatase type titanium oxide having an average primary particle diameter of 30 nm which was surface-treated in the water-wet process by isobutyl trimethoxysilane as a hydrophobing agent. Then the Henschel mixer was used to provide the second treatment, whereby opposite polarity particles were externally added. The details of the processing conditions are given in the samples 1 through 19 of Table 1. In this Table, the amount of external addition is indicated in terms of percentage by mass of opposite polarity particles with respect to 100% by mass of toner base material.

TABLE 1

| Sample number | Opposite polarity particles | Average particle diameter (nm) | Amount of external addition (%) | Henschel mixer speed (m) | Time (sec.) |
|---|---|---|---|---|---|
| 1 | Strontium titanate | 350 | 2.0 | 40 | 180 |
| 2 | Strontium titanate | 350 | 6.0 | 40 | 180 |
| 3 | Barium zirconate | 230 | 2.0 | 40 | 180 |
| 4 | Barium zirconate | 230 | 2.0 | 40 | 120 |
| 5 | Strontium titanate | 200 | 2.0 | 40 | 180 |
| 6 | Strontium titanate | 200 | 4.0 | 40 | 60 |
| 7 | Barium titanate | 200 | 2.0 | 40 | 180 |
| 8 | Barium titanate | 200 | 2.0 | 40 | 120 |
| 9 | Alumina | 400 | 1.5 | 60 | 120 |
| 10 | Silica | 250 | 6.0 | 20 | 180 |
| 11 | Titana | 400 | 0.2 | 40 | 180 |
| 12 | Titania | 400 | 0.4 | 40 | 180 |
| 13 | Titania | 400 | 5.0 | 20 | 120 |
| 14 | Barium titanate | 200 | 0.4 | 40 | 180 |
| 15 | Barium titanate | 200 | 2.0 | 60 | 180 |
| 16 | Barium titanate | 200 | 6.0 | 20 | 120 |
| 17 | Strontium titanate | 200 | 1.0 | 40 | 180 |
| 18 | Strontium titanate | 200 | 7.0 | 20 | 120 |
| 19 | Strontium titanate | 350 | 2.0 | 60 | 180 |

4. Developer

The carrier for the bizhub C350 by Konica Minolta (particle diameter: about 33 μm) and the aforementioned toner are used as the toner and carrier used in the test. The toner ratio in the developer was 8% by mass. The toner ratio was the percentage of the total amount of the toner and finishing agent with respect to the total amount of developer.

5. Examples 1 through 14 and Comparative Examples 1 through 5

Durability test was conducted using the aforementioned development apparatuses A and B, and toner samples 1 through 19 and the developer. The durability test was conducted using the image forming apparatus which is a modified version of the bizhub C350 by Konica Minolta. 50,000 sheets (A4 horizontal paper) of A4 chart with an image area ratio of 5% was copied to measure the amount of the electrostatic charge of toner of the developer in the initial phase and subsequent to durability test, and the amount of the opposite polarity particles deposited on the carrier surface after durability test. A test was also conducted to measure the relative dielectric constant of the opposite polarity particles used in the test and the amount of deposition of the opposite polarity particles, externally added to the toner, having a diameter of 0.2 through 0.6 μm. Table 2 shows the results of these measurements, the amount of change in the electrostatic charge of toner, and evaluation results.

The following describes the method for each measurement.

(Method of Measuring the Electrostatic Charge of Toner)

The electrostatic charge of toner was measured as follows using the apparatus of FIG. 3. The sampled developer of 1 g was placed uniformly over the entire surface of the conductive sleeve 31. The clearance between the conductive sleeve 31 surface and cylindrical electrode 34 was 2 mm, the rotational speed of the magnet roll 32 provided in the conductive sleeve 31 was 1000 rpm, and the voltage applied from the bias power source 33 was 2 kV. After the sample was left for 30 seconds under this condition, toner was collected by the cylindrical electrode 34. The potential Vm of the cylindrical electrode 34 was read 30 seconds later, and the amount of electrostatic charge of toner was obtained. Further, the mass of the collected toner was measured by a precision balance to obtain the average amount of electrostatic charge.

(Method of Measuring the Relative Dielectric Constant of Opposite Polarity Particles)

Figure 6:
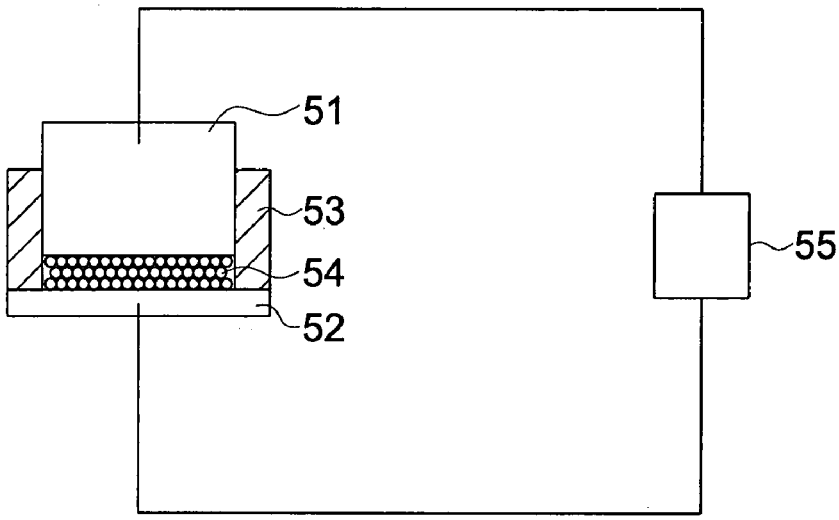
FIG. 6 is a schematic diagram showing an apparatus for measuring the relative dielectric constant of opposite polarity particles.

The relative dielectric constant of the opposite polarity particles was measured using the powder measuring electrode made up of the upper and lower electrodes 51 and 52 and guide 53 shown in FIG. 6, and a LCR meter 55. The following describes the procedure for measurement: 0.30 g of opposite polarity particles were put on the lower electrode 52, and were sandwiched by the upper electrodes 51 and lower electrode 52. After a load of 500 g was applied thereto, a micrometer was used to measure the space between the upper surface of the upper electrode 51 and the bottom surface of the lower electrode 52. The gap between the electrodes was calculated from the thickness of each electrode measured in advance. The electrostatic capacitance between both electrodes was measured by the LCR meter, and the relative dielectric constant $\in_r$ was obtained from the gap between the electrodes and the area of the electrode according to the following calculation formula (1).

$$\in_r = C \cdot L / (\in_0 \cdot S) \quad (1)$$

wherein C is an electrostatic capacitance, S is an area of the electrode, L is a gap between the electrodes, and $\in_0$ is the dielectric constant of vacuum.

(Measuring the Amount of the Opposite Polarity Particles, Having a Particle Diameter of 0.2 through 0.6 μm, Deposited on the Supplemental Toner Surface)

The supplemental toner with opposite polarity particles externally added thereto, and the carrier were mixed so that the toner density (T/C) is 8% by mass in advance. This developer of 30 g was sampled and was put into a 50 ml plastic bottle. This was rotated by a ball mill at a speed of 100 rpm for 30 minutes for mixing and stirring.

The supplemental toner with opposite polarity particles externally added thereto, and the carrier were mixed so that the toner density (T/C) is 8% by mass in advance. This developer of 30 g was sampled and was put into a 50 ml plastic bottle. This was rotated by a ball mill at a speed of 100 rpm for 30 minutes for mixing and stirring.

Figure 4:
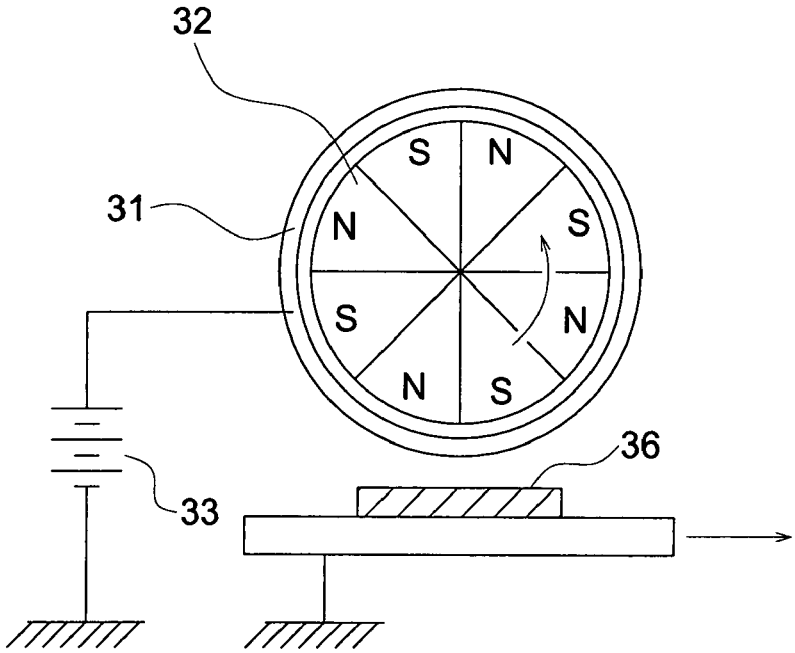
FIG. 4 is a schematic diagram representing the apparatus for separating toner.

After that, in the apparatus of FIG. 4, a developer was uniformly adsorbed uniformly by the magnetic force of the magnet roll 32 onto the surface of the conductive sleeve 31 provided rotatably with respect to the magnet roll 32 in the circumferential direction, and the magnet roll 32 was rotated while voltage was applied from the bias power source 33. The developer was passed over the conductive flat electrode 36 connected to the ground, and the toner of the developer and the opposite polarity particles attached to toner were made to fly by the electric field so that a toner layer (M1 g) was formed on the surface of the flat electrode 36. The voltage used in this case was 150 V, and the closest distance between the surface of the conductive sleeve 31 and the upper surface of the flat electrode 36 was 2 mm. In this case, the electric field having been formed was as small as 150 V/2 mm=$0.075\times10^6$ V/m so that the opposite polarity particles would not be separated from the toner. After the toner layer was formed, the flat electrode 36 was replaced on the apparatus of FIG. 5.

Figure 5:
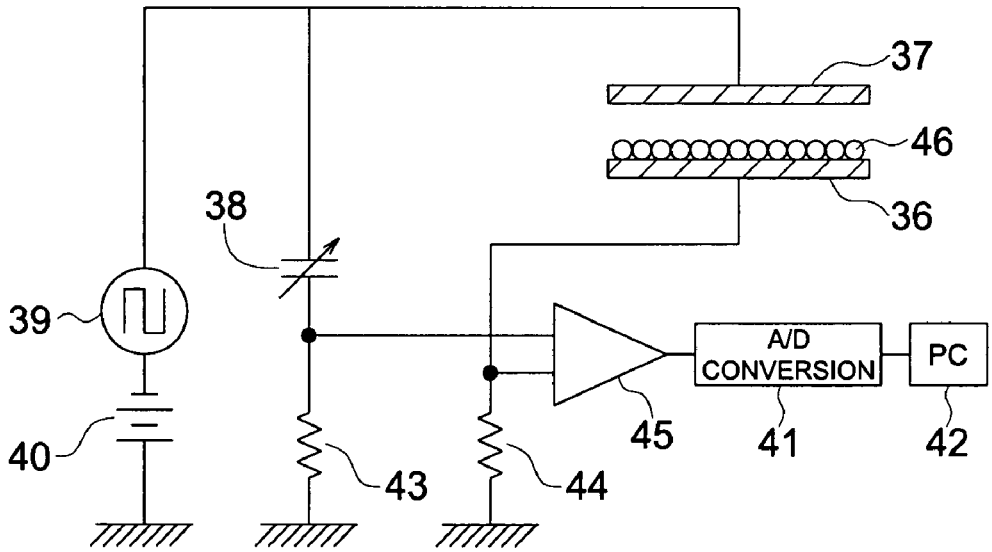
FIG. 5 is a schematic diagram representing the apparatus for separating opposite polarity particles.

The apparatus of FIG. 5 is what is disclosed on page 17 of the Collected Research Paper Read at the Japan Hardcopy 2004 Fall Meeting. It is the apparatus to capture the inductive charge resulting from the charged particle movement between the parallel and flat electrodes 36 and 37. The voltage obtained by superimposing the rectangular wave having a frequency of 2 kHz and Vpp of 1200 V onto the DC voltage of −150 V was applied from the power sources 39 and 40 in twenty cycles using this apparatus. Application of voltage was stopped after the voltage prior to stop of application was −750 V as a negative level in the applied waveform. The space between the parallel and flat electrode was 150 μm. Opposite polarity particles were separated from the toner by the electric field formed in this manner and were moved back and forth in the direction reverse to the toner. After that, they deposited on the electrode 37 and were stopped there. In the meantime, the toner moved back and forth, and was deposited on the electrode 36. Particles having moved from the electrode 36 to the electrode 37 were only the opposite polarity particles, and almost all the opposite polarity particles having a diameter of 0.2 through 0.6 μm could be moved. The mass (Ma g) of opposite polarity particles were measured based on the weight of the opposite polarity particles deposited on the electrode.

(Diameter of the Opposite Polarity Particles)

The diameter of the opposite polarity particles was measured as follows. The opposite polarity particles deposited on the aforementioned electrode were photographed by the scanning electron microscope (SEM), VE 8800 by Keyence Corp., and the image thereof was analyzed according to the method of analyzing the particle diameter with the image processing software, Image-ProPlus manufactured by Media Cybernetics (U.S.A.). The SEM image was photographed until the number of particles reached 300, and the distribution of 300 particles and the number of particles were measured. The number ratio of the opposite polarity particles having a diameter of 0.2 through 0.6 μm was calculated from this distribution of particle diameter, and the result was converted to mass ratio. The amount G (% by mass) of the opposite polarity particles having a diameter of 0.2 through 0.6 μm deposited on the supplemental toner was calculated from these values using the following calculation formula (2).

$$G=(Ma/M1)\times k\times 100 \quad (2)$$

(Method of Measuring the Amount of Opposite Polarity Particles Deposited on the Surface of Carrier)

The developer was taken from the developer tank, and the carrier was separated from the developer using the apparatus of FIG. 3. The amount of the opposite polarity particles on the separated carrier was analyzed and quantified by a fluorescent X-ray analysis apparatus (ZSX 100e by Rigaku Inc.), and the amount of the opposite polarity particles deposited on the carrier surface was obtained in terms of percentage by mass with respect to 100% by mass of the carrier.

(Evaluation of the Test)

The evaluation was made according to the following criteria:

A: Change in the electrostatic charge of toner is less than 5.0 μC in terms of absolute value B: Change in the electrostatic charge of toner is 5.0 μC or more and less than 10.0 μC in terms of absolute value C: Change in the electrostatic charge of toner is 10.0 μC or more and less than 20 μC in terms of absolute value D: Change in the electrostatic charge of toner is equal to or greater than 20 μC in terms of absolute value.

TABLE 2

| | | Opposite polarity particles | | | | Development apparatus A | | | | Development apparatus B | | | |
|---|---|---|---|---|---|---|---|---|---|---|---|---|---|
| | Toner used | Type of particles | *1 | *2 | *3 | Initial (−μC/g) | *4 | ΔQ (−μC/g) | *5 | Initial (−μC/g) | *4 | ΔQ (−μC/g) | *5 |
| Example 1 | Sample 1 | Strontium titanate | 7.6 | 0.8 | 0.018 | 32.0 | 33.0 | 1.0 | A | 34.5 | 33.5 | −1.0 | A |
| Example 2 | Sample 2 | Strontium titanate | 7.6 | 4.0 | 0.100 | 32.4 | 34.4 | 2.0 | A | 35.6 | 36.6 | 1.0 | A |
| Example 3 | Sample 3 | Barium zirconate | 6.7 | 0.3 | 0.012 | 33.8 | 31.8 | −2.0 | A | 33.9 | 32.9 | −1.0 | A |

TABLE 2-continued

| | | Opposite polarity particles | | | | Development apparatus A | | | | Development apparatus B | | | |
|---|---|---|---|---|---|---|---|---|---|---|---|---|---|
| | Toner used | Type of particles | *1 | *2 | *3 | Initial (−μC/g) | *4 | ΔQ (−μC/g) | *5 | Initial (−μC/g) | *4 | ΔQ (−μC/g) | *5 |
| Example 4 | Sample 4 | Barium zirconate | 6.7 | 0.6 | 0.027 | 31.8 | 32.8 | 1.0 | A | 34.1 | 35.1 | 1.0 | A |
| Example 5 | Sample 5 | Strontium titanate | 7.8 | 0.2 | 0.010 | 33.2 | 31.2 | −2.0 | A | 36.0 | 34.0 | −2.0 | A |
| Example 6 | Sample 6 | Strontium titanate | 7.8 | 1.6 | 0.037 | 31.4 | 31.4 | 0.0 | A | 35.3 | 37.3 | 2.0 | A |
| Example 7 | Sample 7 | Barium titanate | 19.8 | 0.2 | 0.016 | 31.8 | 30.8 | −1.0 | A | 34.9 | 36.9 | 2.0 | A |
| Example 8 | Sample 8 | Barium titanate | 19.8 | 0.8 | 0.018 | 32.5 | 30.5 | −2.0 | A | 34.7 | 38.7 | 4.0 | A |
| Comp. 1 | Sample 9 | Alumina | 4.0 | 0.3 | 0.013 | 31.7 | 19.7 | −12.0 | C | 36.1 | 23.6 | −12.5 | C |
| Comp. 2 | Sample 10 | Silica | 2.2 | 4.5 | 0.150 | 33.1 | 15.1 | −18.0 | C | 35.7 | 18.7 | −17.0 | C |
| Comp. 3 | Sample 11 | Titania | 5.0 | 0.07 | 0.003 | 33.7 | 17.2 | −16.5 | C | 35.1 | 21.1 | −14.0 | C |
| Comp. 4 | Sample 12 | Titania | 5.0 | 0.15 | 0.009 | 33.2 | 22.7 | −10.5 | C | 35.3 | 24.3 | −11.0 | C |
| Comp. 5 | Sample 13 | Titania | 5.0 | 4.5 | 0.160 | 32.1 | 21.6 | −10.5 | C | 34.3 | 23.3 | −11.0 | C |
| Example 9 | Sample 14 | Barium titanate | 19.8 | 0.04 | 0.001 | 32.6 | 23.6 | −9.0 | B | 34.0 | 24.4 | −9.6 | B |
| Example 10 | Sample 15 | Barium titanate | 19.8 | 0.08 | 0.006 | 31.9 | 24.9 | −7.0 | B | 33.7 | 24.7 | −9.0 | B |
| Example 11 | Sample 16 | Barium titanate | 19.8 | 5.0 | 0.250 | 31.8 | 41.6 | 9.8 | B | 35.6 | 45.1 | 9.5 | B |
| Example 12 | Sample 17 | Strontium titanate | 7.8 | 0.11 | 0.003 | 33.4 | 25.4 | −8.0 | B | 35.8 | 26.3 | −9.5 | B |
| Example 13 | Sample 18 | Strontium titanate | 7.8 | 6.8 | 0.300 | 33.6 | 43.4 | 9.8 | B | 33.7 | 43.2 | 9.5 | B |
| Example 14 | Sample 19 | Strontium titanate | 7.6 | 0.1 | 0.008 | 32.1 | 25.1 | −7.0 | B | 34.5 | 25.5 | −9.0 | B |

*1: Relative dielectric constant
*2: Amount of the opposite polarity particles deposited on the supplemental toner surface (% by mass)
*3: Amount of the opposite polarity particles deposited on carrier surface (% by mass)
*4: After durability test (−μC/g)
*5: Evaluation
Comp.: Comparative example Table 2 shows that, if the relative dielectric constant of the opposite polarity particles is equal to or greater than 6.7, the change in the electrostatic charge of toner is a little, and sufficient stability is ensured. Further, when the relative dielectric constant of the opposite polarity particles is equal to or greater than 6.7, and the amount of opposite polarity particles deposited on the carrier surface subsequent to durability test is 0.01 through 0.1% by mass, reduction in the charging property of the carrier at the time of durability test is very small. Further, if the amount of the opposite polarity particles having a diameter of 0.2 through 0.6 μm deposited on the surface of the supplemental toner is 0.2 through 4% by mass, the amount of the opposite polarity particles deposited on the carrier surface can be kept in the optimum range.

What is claimed is:

1. A development apparatus for developing an electrostatic latent image in a development area, the apparatus comprising:

a developer tank which is adapted to store developer including toner, carrier for charging the toner, and opposite polarity particles which are to be charged in an opposite polarity to a polarity of electrostatic charge of the toner; and a conveyance mechanism which is adapted to convey the toner separated from the opposite polarity particles to the development area and to collect the opposite polarity particles separated from the toner back into the developer tank, wherein the relative dielectric constant of the opposite polarity particles is no less than 6.7 at 25° C.

2. The development apparatus of claim 1, wherein an amount of the opposite polarity particles which are deposited on a surface of the carrier is from 0.01 to 0.1% by mass with respect to an amount of the carrier.

3. The development apparatus of claim 1, comprising:

a supply mechanism which is adapted to supply the developer tank with toner, wherein the opposite polarity particles are deposited on surfaces of the toner to be supplied by the supply mechanism, and an amount of the deposited opposite polarity particles whose diameter is from 0.2 to 0.6 μm is from 0.2 to 4.0% by mass with respect to an amount of the toner.

4. The development apparatus of claim 1, wherein a number average particle diameter of the opposite polarity particles is from 100 to 1000 nm.

5. The development apparatus of claim 1, wherein the conveyance mechanism comprises:

a developer supporting member which is adapted to support the developer supplied from the developer tank;

a separation member which is provided facing the developer supporting member and is adapted to separate the opposite polarity particles from the developer on the developer supporting member; and an electric field forming mechanism which is adapted to form an electric field between the developer supporting member and the separation member.

6. The development apparatus of claim 1, wherein the conveyance mechanism comprises:

a developer supporting member which is adapted to support the developer supplied from the developer tank;

a toner supporting member which is provided facing the developer supporting member and is adapted to support thereon the toner separated from the opposite polarity particles and transferred from the developer supporting member, and convey the toner to the development area; and an electric field forming mechanism which is adapted to form an electric field between the developer supporting member and the toner supporting member so that the electric field separates the toner and the opposite polarity particles from each other.

7. An image forming apparatus, comprising:

an image carrier;

an image forming mechanism which is adapted to form an electrostatic latent image on the image carrier; and a development apparatus which is adapted to develop in a development area the electrostatic latent image formed on the image carrier, the development apparatus including:

a developer tank which is adapted to store developer including toner, carrier for charging the toner, and opposite polarity particles which are charged in an opposite polarity to a polarity of electrostatic charge of the toner; and a conveyance mechanism which is adapted to convey the toner separated from the opposite polarity particles to the development area and to collect the opposite polarity particles separated from the toner back into the developer tank, wherein the relative dielectric constant of the opposite polarity particles is no less than 6.7 at 25° C.

8. The image forming apparatus of claim 7, wherein an amount of the opposite polarity particles which are deposited on surfaces of the carrier is from 0.01 to 0.1% by mass with respect to an amount of the carrier.

9. The image forming apparatus of claim 7, the development apparatus comprises:

a supply mechanism which is adapted to supply the developer tank with toner, wherein the opposite polarity particles are deposited on surfaces of the toner to be supplied by the supply mechanism, and an amount of the deposited opposite polarity particles whose diameter is from 0.2 to 0.6 μm is from 0.2 to 4.0% by mass with respect to an amount of the toner.

10. The image forming apparatus of claim 7, wherein a number average particle diameter of the opposite polarity particles is from 100 to 1000 nm.

11. The image forming apparatus of claim 7, wherein the conveyance mechanism comprises:

a developer supporting member which is adapted to support the developer supplied from the developer tank;

a separation member which is provided facing the developer supporting member and is adapted to separate the opposite polarity particles from the developer on the developer supporting member; and an electric field forming mechanism which is adapted to form an electric field between the developer supporting member and the separation member.

12. The image forming apparatus of claim 7, wherein the conveyance mechanism comprises:

a developer supporting member which is adapted to support the developer supplied from the developer tank;

a toner supporting member which is provided facing the developer supporting member and is adapted to support thereon the toner separated from the opposite polarity particles and transferred from the developer supporting member and convey the toner to the development area; and an electric field forming mechanism which is adapted to form an electric field between the developer supporting member and the toner supporting member so that the electric field separates the toner and the opposite polarity particles from each other.

13. A method for developing an electrostatic latent image in a development area, the method comprising the steps of:

storing a developer in a developer tank, the developer including toner, carrier for charging the toner, and opposite polarity particles which are to be charged in an opposite polarity to a polarity of electrostatic charge of the toner;

separating the toner and the opposite polarity particles from each other by an electric field;

conveying the toner separated from the opposite polarity particles to the development area; and collecting the opposite polarity particles separated from the toner back into the developer tank, wherein a relative dielectric constant of the opposite polarity particles is no less than 6.7 at 25° C.

14. The method of claim 13, wherein an amount of the opposite polarity particles deposited on a surface of the carrier is from 0.01 to 0.1% by mass with respect to an amount of the carrier.

15. The method of claim 13, comprising the steps of:

supplying the developer tank with toner, wherein the opposite polarity particles are deposited on surfaces of the toner to be supplied, and an amount of the deposited opposite polarity particles whose diameter is from 0.2 to 0.6 μm is from 0.2 to 4.0% by mass with respect to an amount of the toner.

16. The method of claim 13, comprising the steps of:

supporting the developer on a developer supporting member to convey the developer from the developer tank;

forming the electric field between the developer supporting member and a toner supporting member so that the toner is separated from the opposite polarity particles and transferred onto the toner supporting member by the electric field, wherein in the step of conveying the toner, the toner supporting member conveys the toner transferred from the developer supporting member.

17. A method for forming an image, the method comprising the steps of:

forming an electrostatic latent image on an image carrier; and developing in a development area the electrostatic latent image on the image carrier, the step of developing the electric latent image includes the steps of:

storing a developer in a developer tank, the developer including toner, carrier for charging the toner, and opposite polarity particles which are to be charged in an opposite polarity to a polarity of electrostatic charge of the toner;

separating the toner and the opposite polarity particles from each other by an electric field;

conveying the toner separated from the opposite polarity particles to the development area; and collecting the opposite polarity particles separated from the toner back into the developer tank, wherein a relative dielectric constant of the opposite polarity particles is no less than 6.7 at 25° C.

18. The method of claim 17, wherein an amount of the opposite polarity particles deposited on a surface of the carrier is from 0.01 to 0.1% by mass with respect to an amount of the carrier.

19. The method of claim 17, comprising the step of:

supplying the developer tank with toner, wherein the opposite polarity particles are deposited on surfaces of the toner to be supplied, and an amount of the deposited opposite polarity particles whose diameter is from 0.2 to 0.6 μm is from 0.2 to 4.0% by mass with respect to an amount of the toner.

20. The method of claim 17, wherein the step of developing the latent image include the step of:

supporting the developer on a developer supporting member to convey the developer from the developer tank;

forming the electric field between the developer supporting member and a toner supporting member so that the toner is separated from the opposite polarity particles and transferred onto the toner supporting member by the electric field, wherein in the step of conveying the toner, the toner supporting member conveys the toner transferred from the developer supporting member.

* * * * *